US009106017B2

(12) United States Patent
Kutsuna et al.

(10) Patent No.: US 9,106,017 B2
(45) Date of Patent: Aug. 11, 2015

(54) TERMINAL PULLOUT STRUCTURE OF CONNECTOR

(71) Applicant: YAZAKI CORPORATION, Minato-ku, Tokyo (JP)

(72) Inventors: Yoji Kutsuna, Shizuoka (JP); Shin Nemoto, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/210,567

(22) Filed: Mar. 14, 2014

(65) Prior Publication Data

US 2014/0193989 A1 Jul. 10, 2014

Related U.S. Application Data

(63) Continuation of application No. PCT/JP2012/006013, filed on Sep. 21, 2012.

(30) Foreign Application Priority Data

Sep. 22, 2011 (JP) ..... 2011-207213

(51) Int. Cl.
*H01R 13/629* (2006.01)
*H01R 13/422* (2006.01)
*H01R 43/22* (2006.01)

(52) U.S. Cl.
CPC ..... *H01R 13/629* (2013.01); *H01R 13/4226* (2013.01); *H01R 43/22* (2013.01)

(58) Field of Classification Search
CPC ..... H01R 13/4223; H01R 13/4361; H01R 13/6272; H01R 43/22
See application file for complete search history.

(56) References Cited

U.S. PATENT DOCUMENTS

| | | | | |
|---|---|---|---|---|
| 3,838,382 | A | 9/1974 | Sugar | |
| 4,762,507 | A | 8/1988 | Rudy, Jr. et al. | |
| 4,864,719 | A | 9/1989 | Rudy, Jr. et al. | |
| 5,057,040 | A | 10/1991 | Kodama et al. | |
| 5,562,500 | A * | 10/1996 | Tsukakoshi | 439/752 |

(Continued)

FOREIGN PATENT DOCUMENTS

| | | | |
|---|---|---|---|
| JP | S63-291378 | A | 11/1988 |
| JP | 2002-367706 | A | 12/2002 |

(Continued)

OTHER PUBLICATIONS

Japanese office action letter issued on May 19, 2015 in the counterpart Japanese patent application.

*Primary Examiner* — Truc Nguyen
(74) *Attorney, Agent, or Firm* — Marvin A. Motsenbocker; Mots Law, PLLC

(57) ABSTRACT

A connector housing includes a terminal receiving chamber and a pair of lances for locking the terminal on both sides of the terminal receiving chamber. A terminal pullout jig inserted into the connector housing displaces the lances to respective unlocking positions, thus pulling out the terminal from the terminal receiving chamber. The connector housing includes a pair of unlocking wall portions configured to be elastically deformed integrally with the pair of lances respectively. The terminal pullout jig includes an unlocking arm portion configured to displace the pair of the lances to the respective unlocking positions, and a terminal pressing portion for pressing the terminal in a terminal pullout direction.

3 Claims, 12 Drawing Sheets

(56) References Cited

U.S. PATENT DOCUMENTS

| | | | | |
|---|---|---|---|---|
| 6,050,860 | A * | 4/2000 | Tsuchiya | 439/748 |
| 6,276,957 | B1 * | 8/2001 | Seko et al. | 439/489 |
| 6,863,568 | B2 * | 3/2005 | Nakamura | 439/595 |
| 7,140,908 | B2 * | 11/2006 | Katsuma | 439/489 |
| 7,661,999 | B2 * | 2/2010 | Horiuchi et al. | 439/752 |
| 8,523,594 | B2 * | 9/2013 | Takeda et al. | 439/352 |
| 8,678,866 | B2 * | 3/2014 | Hiraishi | 439/752 |
| 8,882,528 | B2 * | 11/2014 | Sasho et al. | 439/358 |

FOREIGN PATENT DOCUMENTS

| | | | |
|---|---|---|---|
| JP | 2008-192518 | A | 8/2008 |
| WO | 2012/095934 | A1 | 7/2012 |

* cited by examiner

TERMINAL PULLOUT STRUCTURE OF CONNECTOR

CROSS REFERENCE TO RELATED APPLICATION

This application is a Continuation of PCT Application No. PCT/JP2012/006013, filed on Sep. 21, 2012, and claims the priority of Japanese Patent Application No. 2011-207213, filed on Sep. 22, 2011, the content of both of which is incorporated herein by reference.

BACKGROUND

1. Technical Field

The present disclosure relates to a terminal pullout structure of a connector for pulling out, by using a terminal pullout jig, a terminal received in a connector housing.

2. Related Art

As a conventional connector to which this type of structure is applied, one disclosed in Japanese Patent Unexamined Publication No. 2002-367706 is given. As shown in FIG. 1 and FIG. 2, a connector 50 is provided with a connector housing 51, a plurality of terminals 60, and a retainer 70. The connector housing 51 has a plurality of terminal receiving chambers 52 for receiving the respective terminals 60, a pair of lances 53, 54 for locking the terminal 60 by an elastic deformation from right and left sides of the terminal receiving chamber 52.

The terminal 60 is received in the terminal receiving chamber 52. The terminal 60 is inserted from a rear opening 52*b* of the terminal receiving chamber 52. The terminal 60 has a terminal contact portion 61 configured to have a contact with a mating terminal (not shown) and an electric wire fixing portion 62 to which an end portion of an electric wire W is fixed. On both sides of the terminal 60, the pair of lances 53, 54 lock the terminal contact portion 61 of the terminal 60 received in the terminal receiving chamber 52. Thus, the terminal 60 cannot move in the pullout direction.

The retainer 70 is mated with the connector housing 51 from an inserting side of the mating terminal (not shown). A lance restricting protruding portion 71 is provided at a mating distal end side of the retainer 70. This lance restricting protruding portion 71 prevents the pair of lances 53, 54 from moving in an unlocking direction.

In addition, in FIG. 1, the terminal 60 is positioned in a midway position for insertion into the terminal receiving chamber 52, and in FIG. 2, the terminal 60 is positioned in a proper receiving position of the terminal receiving chamber 52.

In the structure for locking the terminal 60 by the pair of lances 53, 54 as shown in the above conventional example, compared with a case in which a single lance is used for locking the terminal, the terminal 60 can be locked more firmly. However, there was a problem that strengthening of the force for locking the terminal 60 cannot be compatible with workability of pulling out the terminal 60.

That is, with the structure having the single lance, it is sufficient to shift only one lance to an unlocking position by a terminal pullout jig (not shown) to be inserted into the connector housing 51. However, with the structure having the pair of lances 53, 54, it is necessary to shift the pair of lances 53, 54 together to an unlocking position by the terminal pullout jig, thus complicating the unlocking operation. In addition, the terminal pullout jig needs to have a structure having two unlocking arm portions provided with an interval therebetween, thus having a low-strength structure.

Herein, according to the above conventional example, it is so configured that a terminal locking face 53*a* of one lance 53 is defined as a vertical face while a terminal locking face 54*a* of another lance 54 is defined as an inclined face and that unlocking only one lance 53 by the terminal pullout jig can pull out the terminal 60. In this case, however, the force for locking the terminal 60 becomes low, failing to make the strengthening of the force for locking the terminal 60 compatible with the workability of pulling out the terminal 60.

It is an object of the present invention to provide a terminal pullout structure of a connector capable of making the strengthening of a force for locking the terminal compatible with the workability of pulling out the terminal.

Solution to Problem

According to a first aspect of the present invention, there is provided a terminal pullout structure of a connector, including: a terminal receiving chamber provided in a connector housing and configured to receive a terminal; a pair of lances for locking the terminal by an elastic deformation on both sides of the terminal receiving chamber; and a terminal pullout jig connector configured to pull out the terminal from the terminal receiving chamber by being inserted into the connector housing and displacing the pair of the lances to respective unlocking positions, wherein the connector housing includes a pair of unlocking wall portions configured to be elastically deformed integrally with the pair of the lances respectively and arranged in an insertion space for inserting therebetween the terminal pullout jig, and the terminal pullout jig includes: an unlocking arm portion configured to enter into between the pair of the unlocking wall portions in an inserting process into the connector housing and configured to shift the pair of the unlocking wall portions in a direction for expanding an interval between the pair of the unlocking wall portions to thereby displace the pair of the lances to the respective unlocking positions, and a terminal pressing portion for pressing the terminal in a terminal pullout direction in an inserting process after the pair of the lances are displaced to the respective unlocking positions.

The terminal pullout jig may be provided with a prying force restricting portion for restricting an inclination of the unlocking arm portion inserted into the connector housing.

The prying force restricting portion may be slidably provided at the unlocking arm portion and may be biased to a distal end side of the unlocking arm portion by a biasing member.

Advantageous Effects of Invention

According to the first aspect of the present invention, inserting the terminal pullout jig into the connector housing allows the unlocking arm portion of the terminal pullout jig to press and open the area between a pair of unlocking wall portions to thereby shift a pair of lances to the unlocking position. With the inserting of the terminal pullout jig from the present inserting position, the terminal pressing portion of the terminal pullout jig presses the terminal in the pullout direction to thereby move the terminal in the pullout direction. Even when the terminal pullout jig is pulled out, the terminal is not locked to the pair of lances again, therefore, thereafter an operator can pull out the terminal from the terminal receiving chamber. In this way, since the pair of lances can be shifted together to the unlocking positions, the pair of lances can have a structure in which the force for locking the terminal is strengthened. Thus, strengthening of the force for locking the terminal can be compatible with the workability of pulling out the terminal.

DETAILED DESCRIPTION

Hereinafter, embodiments of the present invention will be explained based on the drawings.

First Embodiment

Figure 1:
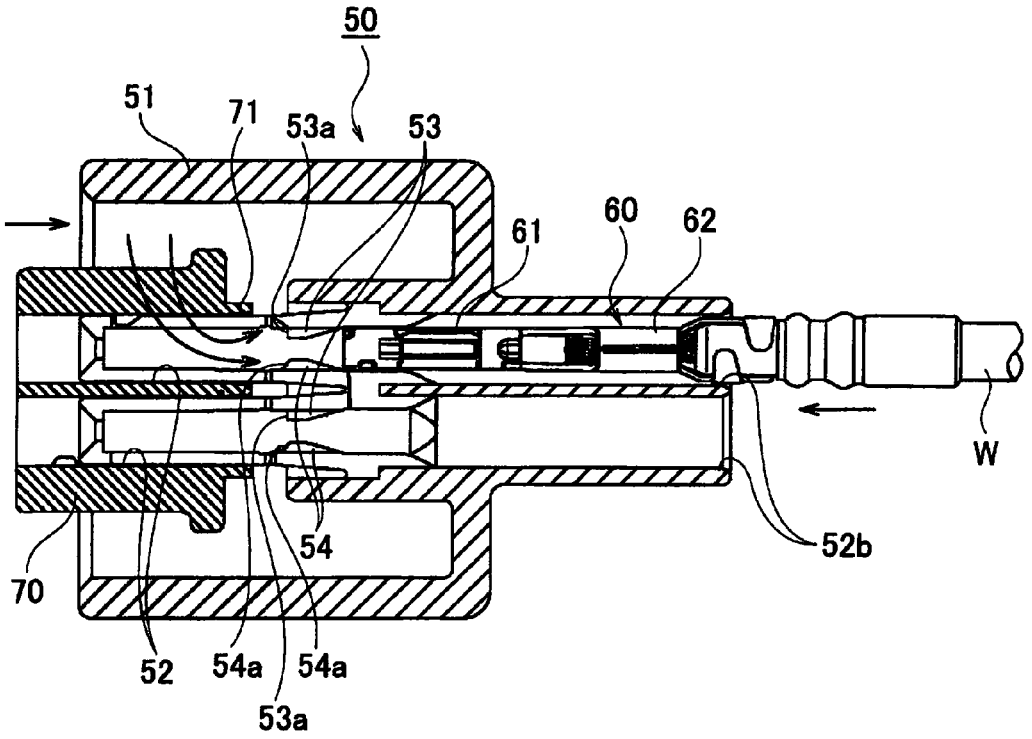
FIG. 1 is a cross sectional view of a connector to which a conventional terminal pullout structure is applied.
Figure 2:
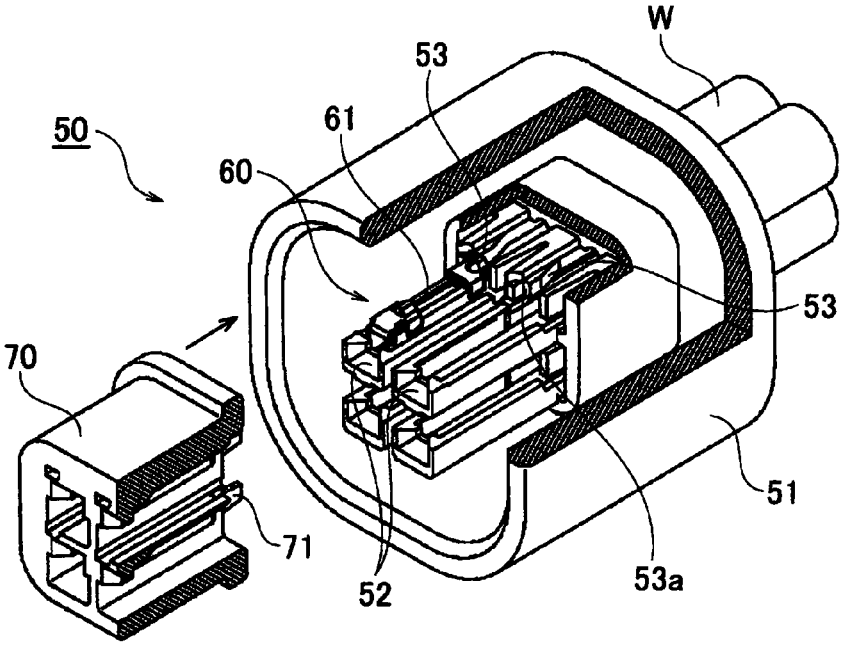
FIG. 2 is a partly broken perspective view of the connector to which the conventional terminal pullout structure is applied.
Figure 3:
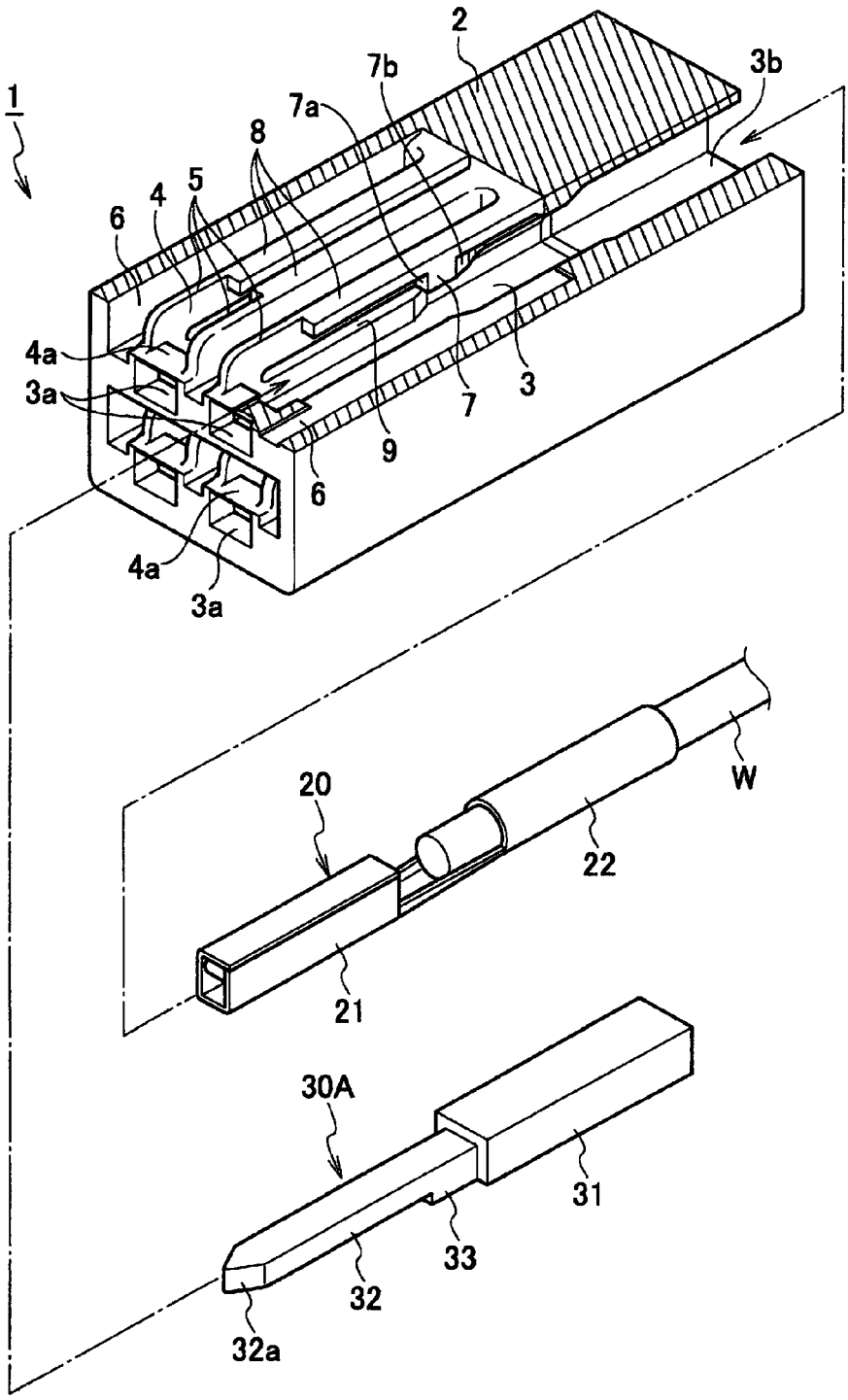
FIG. 3 shows a first embodiment of the present invention and is a perspective of a connector and a terminal pullout jig.
Figure 4:
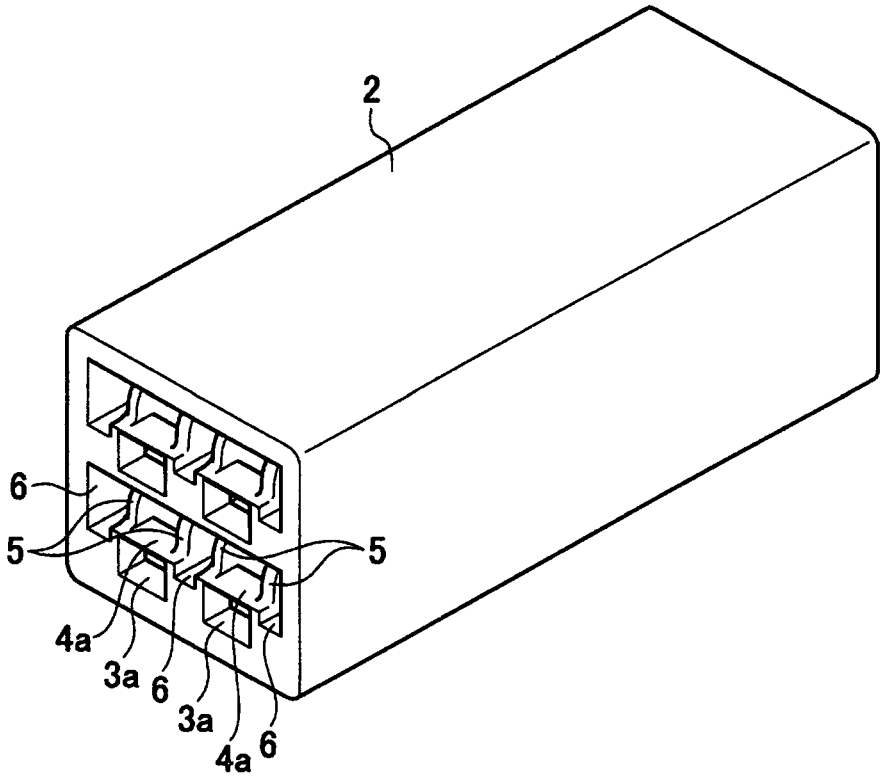
FIG. 4 shows the first embodiment of the present invention and is a perspective view of a connector housing.
Figure 5:
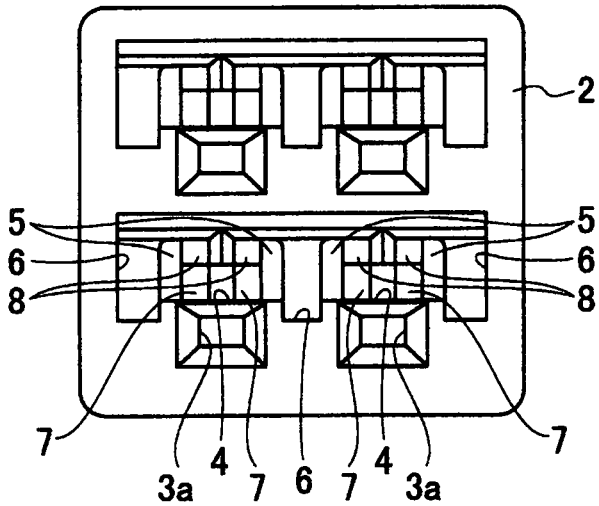
FIG. 5 shows the first embodiment of the present invention and is a front view of the connector housing.
Figure 6:
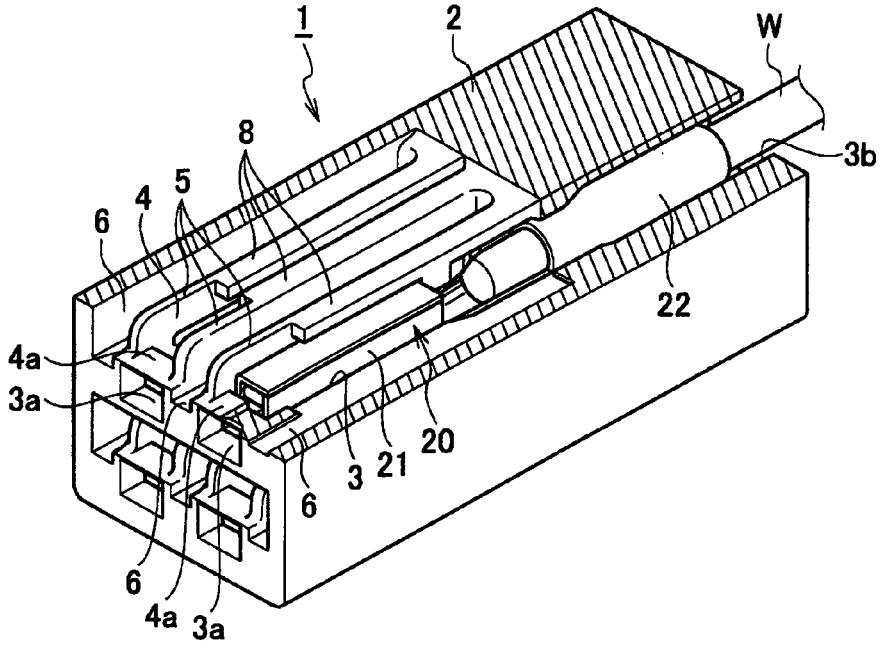
FIG. 6 shows the first embodiment of the present invention and is a broken perspective view of the connector.

FIG. 3 to FIG. 12 show a first embodiment of the present invention. As shown in FIG. 3, a connector 1 is provided with a connector housing 2 and a plurality of terminals 20 (only one terminal 20 is shown in the drawings) received in the connector housing 2. Each terminal 20 has such a terminal pullout structure that the terminal 20 can be pulled out by using a terminal pullout jig 30A.

In FIG. 3 to FIG. 6, the connector housing 2 is provided with four terminal receiving chambers 3 in total, that is, right and left rows (two) and upper and lower steps (two). A mating terminal (not shown) is inserted from a front open portion 3*a* of each of the terminal receiving chambers 3. The terminal 20 is inserted from a rear open portion 3*b* of each of the terminal receiving chambers 3. A terminal forward restricting step face 3*c* is formed at a front side of each of the terminal receiving chambers 3.

A jig insertion chamber 4 is arranged in an upper position of each terminal receiving chamber 3. A bottom face side of each jig insertion chamber 4 is opened to the terminal receiving chamber 3 in the lower position. The terminal pullout jig 30A is inserted from a front open portion 4*a* of each jig insertion chamber 4.

Each terminal receiving chamber 3 and each jig insertion chamber 4 are surrounded by right and left side walls 5. Bending allowing chambers 6 are provided outside the respective side walls 5.

A pair of lances 7 each protruding toward the terminal receiving chamber 3 are provided integrally with the right and left side walls 5. Each lance 7 has a terminal locking face 7*a* formed into a vertical face and a terminal entry face 7*b* formed into an inclined face.

A pair of unlocking wall portions 8 each protruding toward the jig insertion chamber 4 are provided integrally with the right and left side walls 5. The pair of unlocking wall portions 8 extend toward the front side of the jig insertion chamber 4. The pair of unlocking wall portions 8 are arranged at the jig insertion chamber 4 in such a manner as to oppose each other. Each of the unlocking wall portions 8 is integrally fixed to one of the lances 7.

Immediately below each lance 7, a slit 9 extending in the longitudinal direction of the terminal receiving chamber 3 is formed in each of the right and left side walls 5. The slit 9 allows each lance 7 and each unlocking wall portion 8 to make a bending deformation in a direction toward the bending allowing chamber 6. This bending deformation allows each lance 7 to shift to an unlocking position of the terminal 20.

The terminal 20 is received in the terminal receiving chamber 3. The terminal 20 has a terminal contact portion 21 configured to have a contact with the mating terminal and an electric wire fixing portion 22 to which an end portion of an electric wire W is fixed. The terminal contact portion 21 is in a female form. The terminal 20 is inserted from the rear open portion 3*b* of the terminal receiving chamber 3. Though the pair of lances 7 interfere with the terminal contact portion 21 in this inserting process, the terminal 20 is inserted to a predetermined receiving position due to the bending deformation of the pair of lances 7. Forward movement of the terminal 20 is restricted by the terminal forward restricting step face 3*c*. A rear end of the terminal contact portion 21 of the terminal 20 is locked to the pair of lances 7, to thereby restrict the rearward (a direction for pulling out the terminal) movement of the terminal 20. That is, the terminal forward restricting step face 3*c* and the pair of lances 7 position the terminal 20 in a predetermined position of the terminal receiving chamber 3.

As shown in FIG. 3, the terminal pullout jig 30A is provided with a grip portion 31 to be grasped by an operator, an unlocking arm portion 32 protruding forward from the grip portion 31 and a terminal pressing portion 33 provided to be integrated with a root portion of the unlocking arm portion 32. The unlocking arm portion 32 is in a form of a single rod and has such a dimension that the unlocking arm portion 32 can be inserted into the jig insertion chamber 4. A distal end of the unlocking arm portion 32 is formed into a taper face 32*a*. The unlocking arm portion 32 enters into between the pair of unlocking wall portion 8 in the inserting process of inserting the unlocking arm portion 32 into the jig insertion chamber 4, shifts the pair of unlocking wall portions 8 in a direction for expanding an interval between the unlocking wall portions 8, to thereby displace the pair of lances 7 to the respective unlocking positions.

The terminal pressing portion 33 abuts a front end face of the terminal 20 in the inserting process of inserting the terminal pressing portion 33 after the pair of lances 7 are displaced to the respective unlocking positions, to thereby press the terminal 20 in the direction of pulling out the terminal 20.

Figure 7:
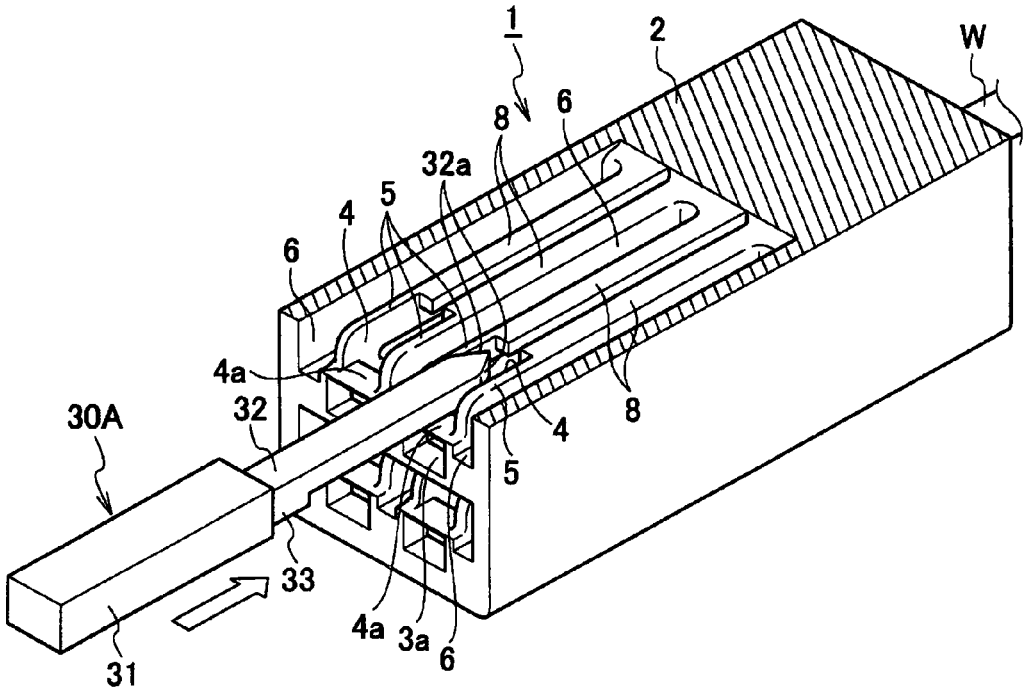
FIG. 7 shows the first embodiment of the present invention and is a partly broken perspective view showing a process of pulling out a terminal of the connector.
Figure 8A:
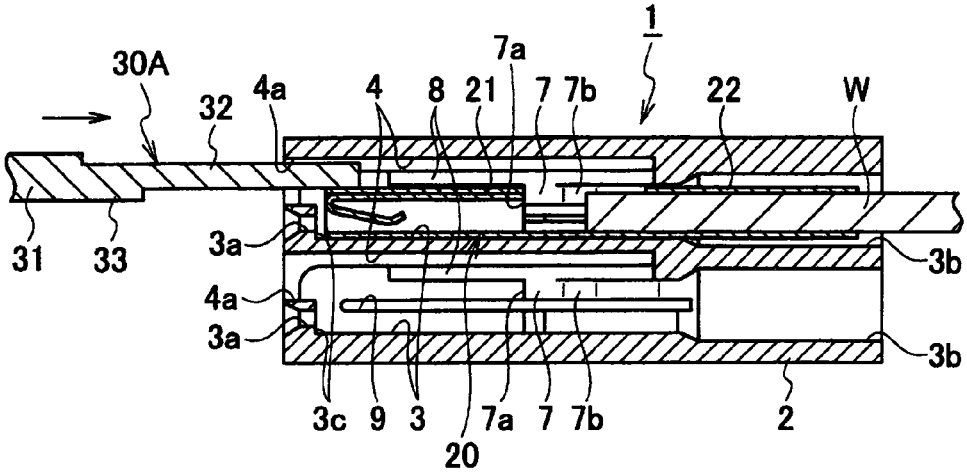
FIG. 8A show the first embodiment of the present invention and is a longitudinal cross sectional view showing the process of pulling out the terminal of the connector.
Figure 8B:
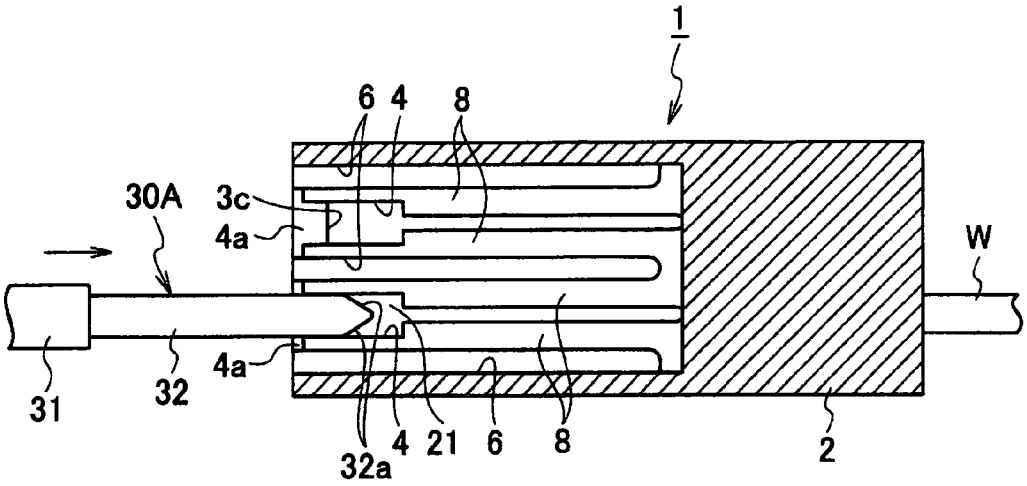
FIG. 8B shows the first embodiment of the present invention and is a lateral cross sectional view showing the process of pulling out the terminal of the connector.

Next, operations of pulling out the terminal of the connector 1 will be explained. As shown in FIG. 7 and FIG. 8, the unlocking arm portion 32 of the terminal pullout jig 30A is inserted from the front open portion 4*a* of the jig insertion chamber 4. Then, the distal end of the unlocking arm portion 32 enters into between the pair of unlocking wall portions 8 and thereby the unlocking arm portion 32 interferes with the pair of unlocking wall portions 8. Herein, the distal end portion of the unlocking arm portion 32 is in a form of a taper face 32*a*, thus allowing the unlocking arm portion 32 to smoothly enter into between the pair of unlocking wall portions 8.

Figure 9:
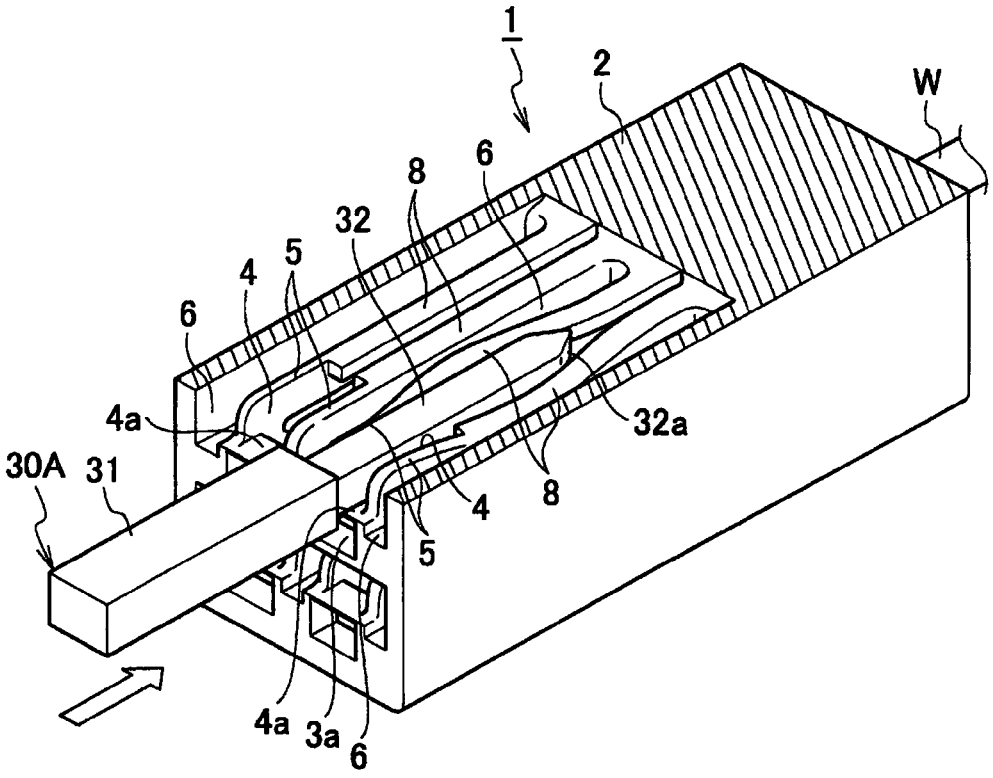
FIG. 9 shows the first embodiment of the present invention and is a partly broken perspective view showing the process of pulling out the terminal of the connector.
Figure 10A:
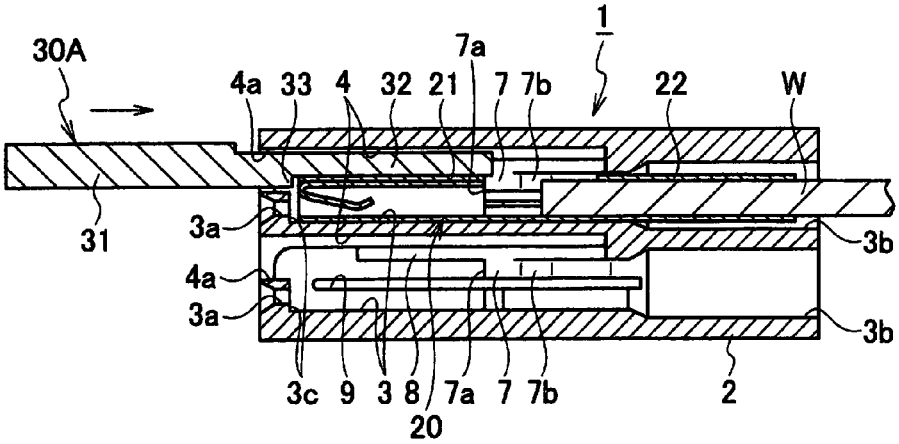
FIG. 10A shows the first embodiment of the present invention and is a longitudinal cross sectional view showing the process of pulling out the terminal of the connector.
Figure 10B:
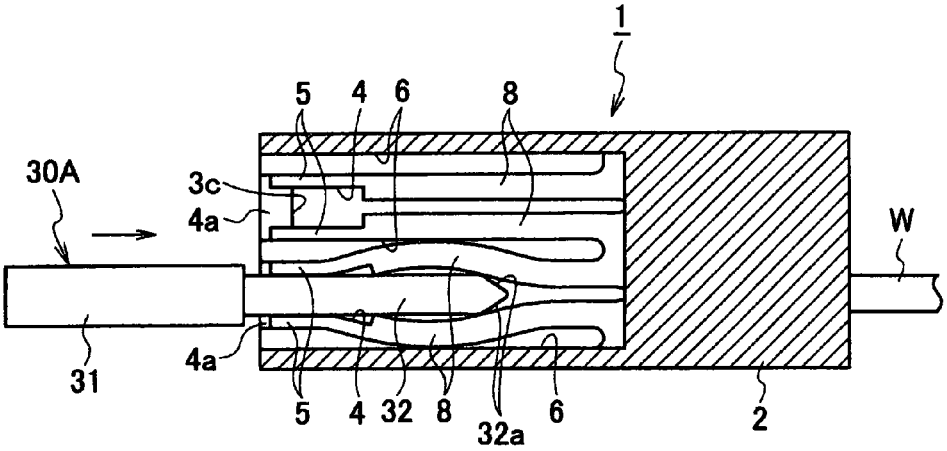
FIG. 10B shows the first embodiment of the present invention and is a lateral cross sectional view showing the process of pulling out the terminal of the connector.

With the terminal pullout jig 30A further inserted from this state, as shown in FIG. 9 and FIG. 10, the unlocking arm portion 32 presses outward the pair of unlocking wall portions 8 to thereby gradually pressingly open the area between the pair of unlocking wall portions 8. Then, the pair of lances 7 also will be gradually shifted in a direction to be spaced apart from each other, that is, to the unlocking position side, and finally the pair of lances 7 are displaced to the unlocking position.

Figure 11:
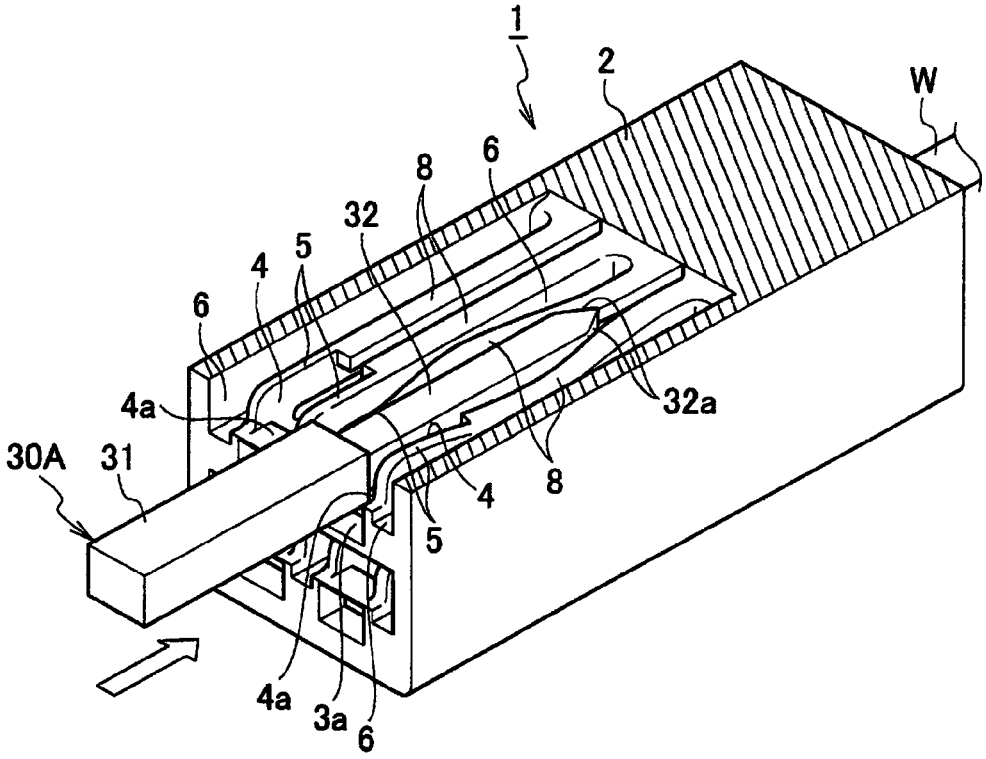
FIG. 11 shows the first embodiment of the present invention and is a partly broken perspective view showing the process of pulling out the terminal of the connector.
Figure 12A:
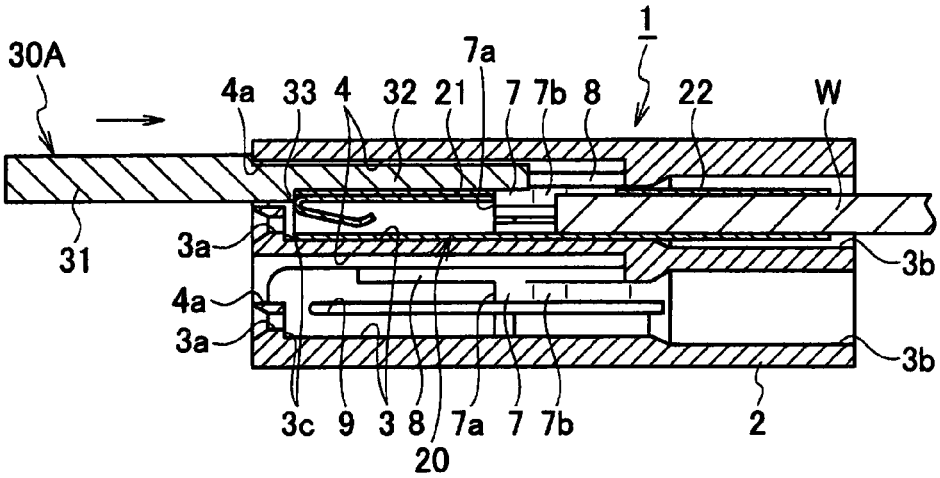
FIG. 12A shows the first embodiment of the present invention and is a longitudinal cross sectional view showing the process of pulling out the terminal of the connector.
Figure 12B:
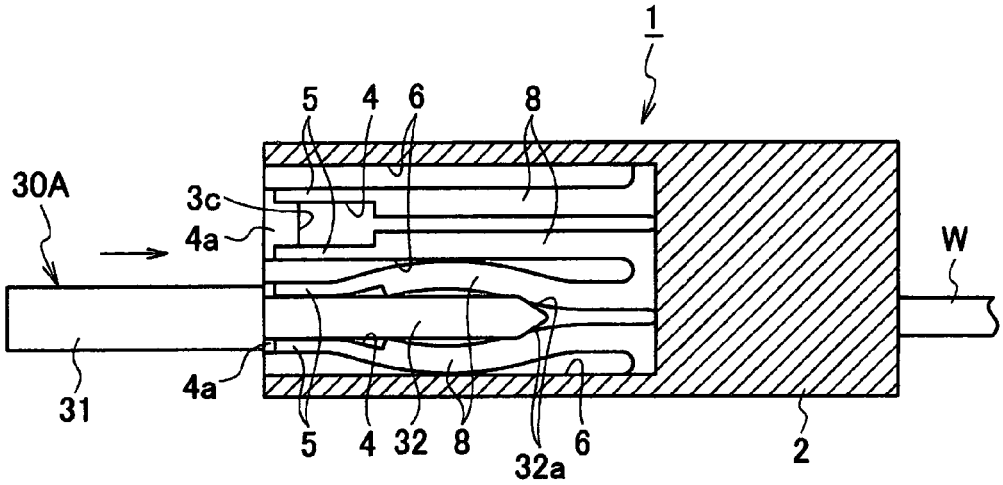
FIG. 12B shows the first embodiment of the present invention and is a lateral cross sectional view showing the process of pulling out the terminal of the connector.

With the inserting of the terminal pullout jig 30A further proceeded from the present inserting position, as shown in FIG. 11 and FIG. 12, the terminal pressing portion 33 of the terminal pullout jig 30A abuts the front end face of the terminal 20 to thereby press the terminal 20 in the pullout direction. This pressing force moves the terminal 20 in the pullout direction. After the terminal 20 has been moved in the pullout direction as described above, the terminal pullout jig 30A is pulled out from the jig insertion chamber 4.

When the terminal pullout jig 30A is pulled out from the jig insertion chamber 4, it is likely that the pair of unlocking wall portions 8 and the pair of lances 7 will return to the original position by a recovery force. However, since the terminal 20 has been shifted in the pullout direction from the predetermined position, the pair of lances 7 will not lock the terminal 20 again.

When the operator pulls the wire W rearward after the terminal pullout jig 30A is pulled out from the jig insertion chamber 4, the terminal 20 can be smoothly pulled out from the terminal receiving chamber 3. This completes the operations of pulling out the terminal 20 of the connector 1.

As explained in the above operations of pulling out the terminal 20 of the connector 1, only inserting the terminal pullout jig 30A into the jig insertion chamber 4 can shift the pair of lances 7 together to the unlocking position. Thus, the pair of lances 7 can have a structure in which the force for locking the terminal 20 is high. As described above, the strengthening of the force for locking the terminal 20 can be compatible with the workability of pulling out the terminal 20.

It is sufficient that the terminal pullout jig 30A has such a structure as to have the single unlocking arm portion 32, thus accomplishing a strengthened structure.

Second Embodiment

Figure 13:
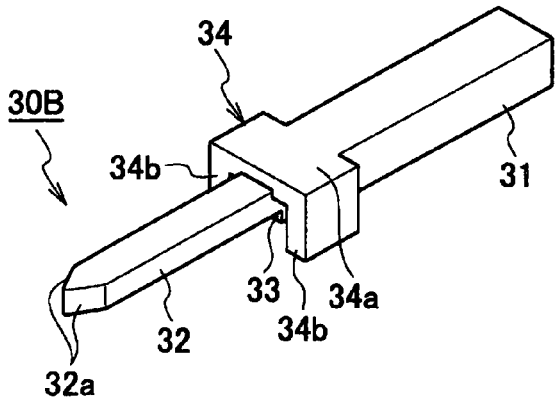
FIG. 13 shows a second embodiment of the present invention and is a perspective view of a terminal pullout jig.
Figure 14:
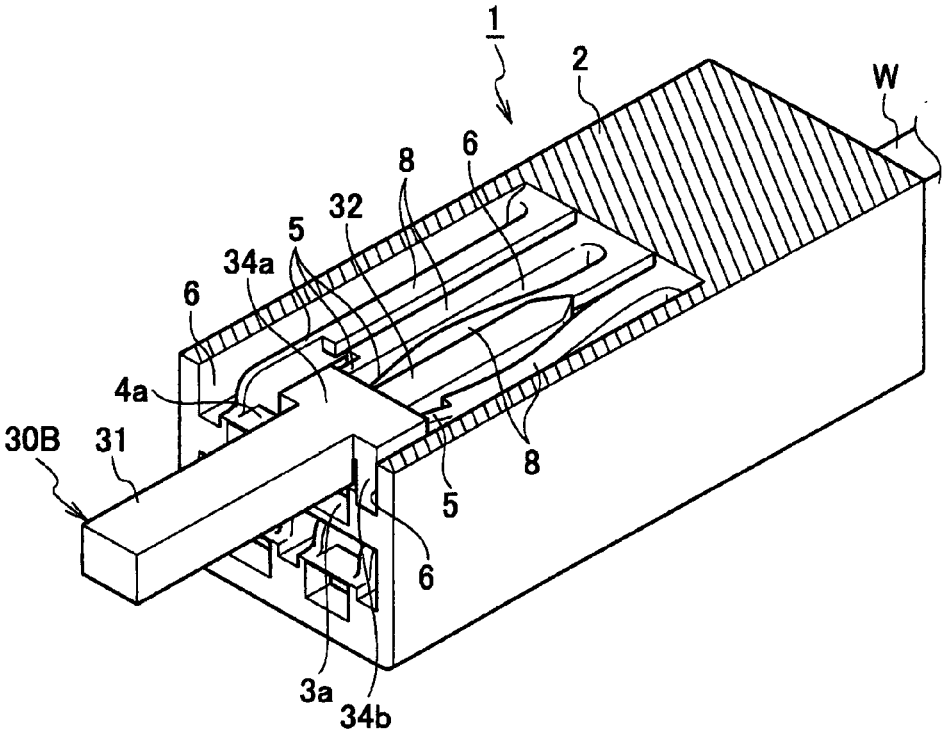
FIG. 14 shows the second embodiment of the present invention and is a partly broken perspective view showing the process of pulling out the terminal of the connector.

FIG. 13 and FIG. 14 show a second embodiment of the present invention. The second embodiment is different from the first embodiment in only structure of the terminal pullout jig, that is, a terminal pullout jig 30B according to the second embodiment is different in structure from the terminal pullout jig 30A according to the first embodiment. The structure of the connector 1 according to the second embodiment is the same as the counterpart according to the first embodiment described above, therefore an explanation thereof will be omitted. For clarification purpose, the same reference numerals or signs will be added to the same structural elements in the drawings.

As shown in FIG. 13, the terminal pullout jig 30B according to the second embodiment is provided with the grip portion 31 grasped by the operator, the unlocking arm portion 32 protruding forward from the grip portion 31, the terminal pressing portion 33 provided to be integrated with the unlocking arm portion 32 at the root portion of the unlocking arm portion 32, and a prying force restricting portion 34.

Structures of the grip portion 31, the unlocking arm portion 32, and the terminal pressing portion 33 according to the second embodiment are the same as those according to the first embodiment, therefore explanation thereof will be omitted.

The prying force restricting portion 34 is provided to be integrated with the grip portion 31. The prying force restricting portion 34 has an upper face wall 34*a* and a pair of hanging walls 34*b* hanging from both ends of the upper face wall 34*a*. In the inserting process of inserting the terminal pullout jig 30B into the jig insertion chamber 4, the upper face wall 34*a* enters into the jig insertion chamber 4 and the pair of hanging walls 34*b* enter into the bending allowing chamber 6 at both outsides of the jig insertion chamber 4, thus the unlocking arm portion 32 inserted into the jig insertion chamber 4 cannot be inclined rightward, leftward or the like.

Like the first embodiment, inserting the terminal pullout jig 30B into the jig insertion chamber 4 can shift the pair of lances 7 together to the unlocking position and can move the terminal 20 in the pullout direction, according to the second embodiment. Thus, the strengthening of the force for locking the terminal 20 can be compatible with the workability of pulling out the terminal 20.

The terminal pullout jig 30B has the prying force restricting portion 34. As shown in FIG. 14, the prying force restricting portion 34 of the terminal pullout jig 30B entering into the jig insertion chamber 4 and the bending allowing chamber 6 in the connector housing 2 can prevent the unlocking arm portion 32 from causing a prying force in the jig insertion chamber 4. Thus, the prying force of the unlocking arm portion 32 does not cause an excessive displacement of any one of the pair of lances 7, and a damage to the lance 7 attributable to the excessive displacement of the lance 7 can be prevented.

Third Embodiment

Figure 15:
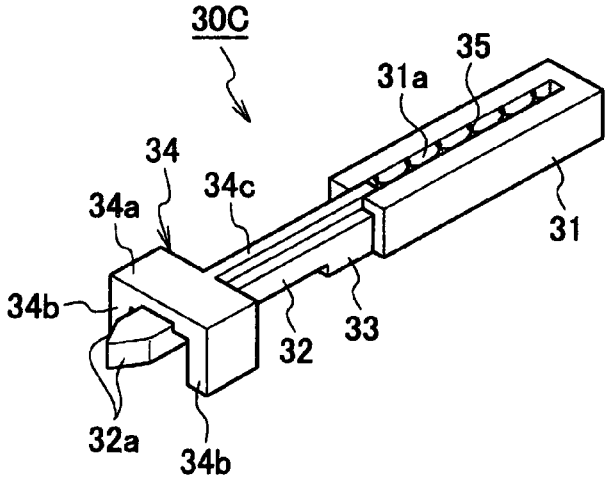
FIG. 15 shows a third embodiment of the present invention and is a perspective view of a terminal pullout jig.
Figure 16:
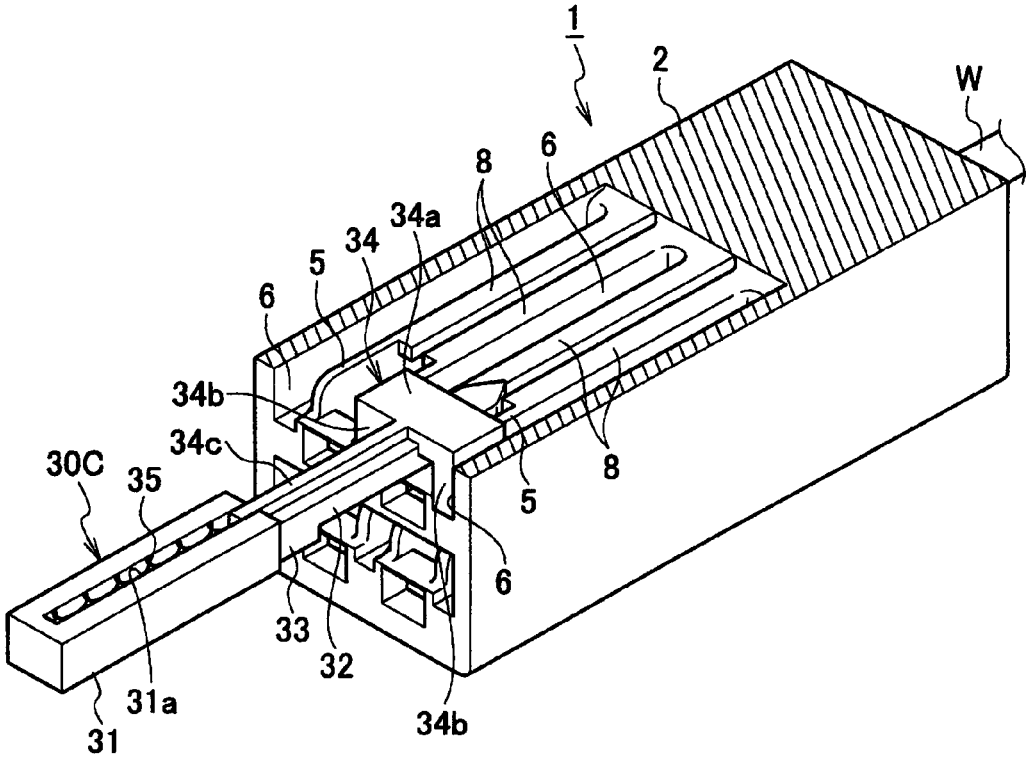
FIG. 16 shows the third embodiment of the present invention and is a partly broken perspective view showing the process of pulling out the terminal of the connector.
Figure 17:
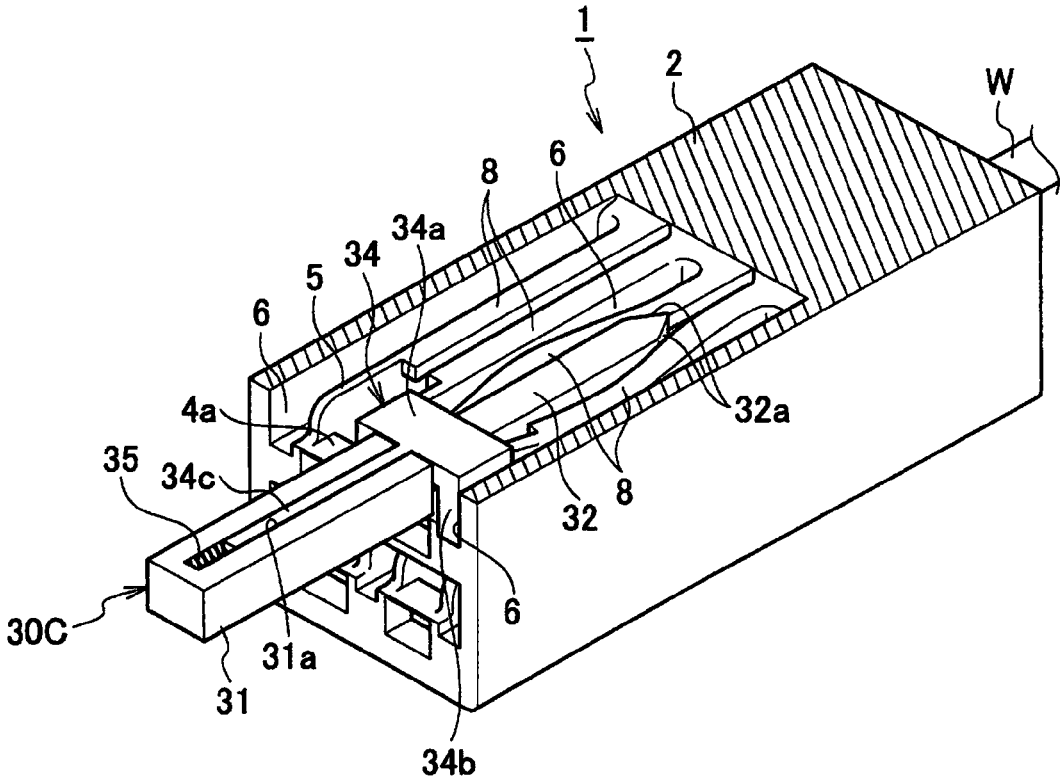
FIG. 17 shows the third embodiment of the present invention and is a partly broken perspective view showing the process of pulling out the terminal of the connector.

FIG. 15 to FIG. 17 show a third embodiment of the present invention. The third embodiment is different from the first embodiment in only structure of the terminal pullout jig, that is, a terminal pullout jig 30C according to the third embodiment is different in structure from the terminal pullout jig 30A according to the first embodiment. The structure of the connector 1 according to the third embodiment is the same as the counterpart according to the first embodiment described above, therefore an explanation thereof will be omitted. For clarification purpose, the same reference numerals or signs will be added to the same structural elements in the drawings.

As shown in FIG. 15, like the terminal pullout jig 30B according to the second embodiment, a terminal pullout jig 30C according to the third embodiment is provided with the grip portion 31 grasped by the operator, the unlocking arm portion 32 protruding forward from the grip portion 31, the terminal pressing portion 33 provided to be integrated with the unlocking arm portion 32 at the root portion of the unlocking arm portion 32, and the prying force restricting portion 34.

The grip portion 31 is provided with a spring receiving chamber 31*a* in the longitudinal direction. The structure of the terminal pressing portion 33 according to the third embodiment is the same as the counterpart according to the first embodiment, therefore an explanation thereof will be omitted.

Unlike the prying force restricting portion 34 according to the second embodiment, the prying force restricting portion 34 according to the third embodiment is not provided to be integrated with the grip portion 31 and is slidably supported on an outer periphery of the unlocking arm portion 32. Like the prying force restricting portion 34 according to the second embodiment, the prying force restricting portion 34 according to the third embodiment has the upper face wall 34*a*, the pair of hanging walls 34*b* hanging from both ends of the upper face wall 34*a*, and a slide rod portion 34*c*. The slide rod portion 34*c* is slidably supported within the spring receiving chamber 31*a* and receives a biasing force of a spring 35 at an end face of the slide rod portion 34*c*. The prying force restricting portion 34 is biased to the distal end side of the unlocking arm portion 32 by a spring force of the spring 35.

Like the first embodiment, inserting the terminal pullout jig 30C into the jig insertion chamber 4 can shift the pair of lances 7 to the unlocking position and can move the terminal 20 in the pullout direction, according to the third embodiment. Thus, the strengthening of the force for locking the terminal 20 can be compatible with the workability of pulling out the terminal 20.

According to the third embodiment, at the initial step of inserting the unlocking arm portion 32 of the terminal pullout jig 30C into the jig insertion chamber 4 of the connector housing 2, as shown in FIG. 16, the prying force restricting portion 34 enters into the jig insertion chamber 4 and the bending allowing chamber 6 of the connector housing 2. Then, from this state, when pressing the grip portion 31 toward the jig insertion chamber 4, the grip portion 31 slides along the slide rod portion 34*c* against the spring force of the spring 35 while the prying force restricting portion 34 maintains the initial position. At the same time, the unlocking arm portion 32 is gradually inserted into the jig insertion chamber 4 as shown in FIG. 17.

Thus, the prying force restricting portion 34 can prevent the prying force of the unlocking arm portion 32 in the entire region in the inserting process of inserting the terminal pullout jig 30C, thus assuredly preventing the damage to the lance 7 attributable to the excessive displacement of the lance 7.

It is possible to provide a terminal pullout structure of a connector capable of making strengthening of a force for locking the terminal compatible with the workability of pulling out the terminal.

What is claimed is:

1. A terminal pullout structure of a connector, comprising:

a terminal receiving chamber provided in a connector housing and configured to receive a terminal;

a pair of lances for locking the terminal by an elastic deformation on both sides of the terminal receiving chamber; and a terminal pullout jig configured to pull out the terminal from the terminal receiving chamber by being inserted into the connector housing and displacing the pair of the lances to respective unlocking positions, wherein the connector housing includes a pair of unlocking wall portions configured to be elastically deformed integrally with the pair of the lances respectively and arranged in an insertion space for inserting therebetween the terminal pullout jig, slits provided to each of the lances in an area on opposite side of the unlocking wall portions and extending in the longitudinal direction of the terminal receiving chamber and the terminal pullout jig includes:

an unlocking arm portion configured to enter into between the pair of the unlocking wall portions in an inserting process into the connector housing and configured to shift the pair of the unlocking wall portions in a direction for expanding an interval between the pair of the unlocking wall portions to thereby displace the pair of the lances to the respective unlocking positions, and a terminal pressing portion for pressing the terminal in a terminal pullout direction in an inserting process after the pair of the lances are displaced to the respective unlocking positions.

2. The terminal pullout structure of the connector according to claim 1 wherein the terminal pullout jig has a prying force restricting portion for restricting an inclination of the unlocking arm portion inserted into the connector housing.

3. The terminal pullout structure of the connector according to claim 2 wherein the prying force restricting portion is slidably provided in the unlocking arm portion and is biased to a distal end side of the unlocking arm portion by a biasing member.

* * * * *